US006585368B1

(12) United States Patent
Park

(10) Patent No.: US 6,585,368 B1
(45) Date of Patent: Jul. 1, 2003

(54) GEAR CLUTCH ASSEMBLY AND METHOD FOR OPERATING A TRANSFIX ROLLER AND A DRUM MAINTENANCE SYSTEM

(75) Inventor: Daniel C. Park, West Linn, OR (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 10/209,740

(22) Filed: Aug. 1, 2002

(51) Int. Cl.[7] ..... B41J 2/01
(52) U.S. Cl. ..... 347/103
(58) Field of Search ..... 347/103, 37, 101, 347/104, 38, 160, 167, 170; 346/134, 138; 400/185, 186, 187, 323, 319, 283; 271/4.04, 4.01, 10.04, 10.01; 399/107; 73/864.16, 864.11, 864.01

(56) References Cited

U.S. PATENT DOCUMENTS

| | | | | |
|---|---|---|---|---|
| 4,539,854 | A | * | 9/1985 | Bradshaw et al. |
| 4,553,033 | A | | 11/1985 | Hubble, III et al. |
| 4,748,474 | A | | 5/1988 | Kurematsu et al. |
| 5,777,650 | A | | 7/1998 | Blank |
| 5,946,525 | A | | 8/1999 | Okamura et al. |
| 6,059,397 | A | | 5/2000 | Jones |
| 6,084,622 | A | * | 7/2000 | Sugiura et al. |
| 6,233,413 | B1 | | 5/2001 | Folkins |

FOREIGN PATENT DOCUMENTS

JP 409083723 A * 3/1997

* cited by examiner

*Primary Examiner*—Raquel Yvette Gordon
(74) *Attorney, Agent, or Firm*—Fay, Sharpe, Fagan, Minnich & McKee, LLP

(57) ABSTRACT

A gear assembly for a print device includes an input gear connected to a drive shaft of a motor, a first output gear and a second output gear. The first output gear operates a transfix roller in the print device and is spaced relative to the input gear to allow teeth of the input gear to mesh with teeth of the first output gear. The first output gear includes a first toothless portion that does not mesh with teeth of the input gear when the input gear is adjacent the first toothless portion. The second output gear operates a drum maintenance system in the print device and is spaced relative to the input gear to allow teeth of the input gear to mesh with teeth of the second output gear. The second output gear includes a second toothless portion that does not mesh with teeth of the input gear when the input gear is adjacent the second toothless portion. The gear assembly further includes a swing arm for rotating the first output gear when the input gear is adjacent the first toothless portion and the. second output gear when the input gear is adjacent the second toothless portion. The rotation of the first output gear moving the first toothless portion away from the input gear and allowing teeth of the input gear to engage teeth of the first output gear. The rotation of the second output gear moving the second toothless portion away from the input gear and allowing teeth of the input gear to engage teeth of the second output gear.

23 Claims, 12 Drawing Sheets

GEAR CLUTCH ASSEMBLY AND METHOD FOR OPERATING A TRANSFIX ROLLER AND A DRUM MAINTENANCE SYSTEM

BACKGROUND OF THE INVENTION

The present invention relates to printer devices. More particularly, the invention relates to a gear clutch assembly and method for operating a transfix roller and a drum maintenance system using a single motor without electromagnetic solenoids or clutches and will be described with particular references thereto. However, it is to be appreciated that the present invention may also be amendable for other applications.

In many print devices, an intermediate transfer surface, such as a transfer drum, is used to deliver printer ink from a print head to a print or receiving medium such as paper. More specifically, ink is ejected from jets in the print head onto the transfer drum creating a liquid layer of ink. The receiving medium is then brought into contact with the transfer drum and the ink image is transferred and fused or fixed to the receiving medium.

To assist in the transfer and fixing of the ink image, a transfix roller is often utilized to apply a pressure to the receiving medium thereby pressing the receiving medium against the transfer drum. When or around the time the receiving medium engages the transfer drum for transfixing of the image on the receiving medium, the transfix roller is moved from an idle unloaded or disengaged position toward a loaded or engaged position. In the loaded position, the receiving medium is sandwiched between the transfer roller and the transfer drum. After the ink image is transfixed on the receiving medium and the receiving medium is ready or about ready to disengage from the transfer drum, the transfix roller is moved from the loaded position toward an unloaded position to permit the receiving medium to exit from the transfix roller and transfer drum. The transfix roller remains in the unloaded position until the next transfix operation occurs.

After the ink is transfixed to the receiving medium from the transfer drum, the transfer drum requires conditioning for a subsequent ink jetting from the print head. Typically, a drum maintenance system is used to condition the transfer drum for receipt of the next ink image. The drum maintenance system, when activated, moves from an idle or disengaged position to an operating or engaged position. In the engaged position, a roller included in the drum maintenance system applies an oil or other similar functioning substance to the transfer drum. The oil reduces the probability that ink sprayed onto the transfer drum will stick to the transfer drum during the transfix operation. The drum maintenance system also includes a plastic or rubber blade that approaches or engages the transfer drum when the drum maintenance system is in the engaged position. The blade meters the oil being applied to the transfer drum. While the drum maintenance system is in the engaged position, the transfix roller remains in its idle unloaded position. Upon completion of the drum maintenance operation, the drum maintenance system is moved to its idle position.

Typically, the transfix roller and the drum maintenance system are cam driven. That is, each of the transfix roller and the drum maintenance system are driven by independent cam mechanisms, a transfix cam mechanism and a drum maintenance cam mechanism. The prior art generally recognizes two systems or methods of operating the transfix roller and drive maintenance system cam mechanisms. First, two separate motors may be used. The first motor would drive the transfix cam mechanism and the second motor would drive the drum maintenance cam mechanism. A disadvantage of the two motor system is the cost for including two such motors in a print device and the spacial and volumetric constraints of print devices.

In the second prior art system, a single motor is used to drive both the transfix cam mechanism and the drum maintenance cam mechanism. Independent control of the cam mechanisms is achieved through the use of electromagnetic clutches or electromagnetic solenoids. There are several disadvantages in the single motor/electromagnetic clutch or solenoid system. First, electromagnetic clutches and solenoids are unreliable as they tend to fail and render their print devices inoperable. Second, although not always as costly as the two motor system, electromagnetic clutches and solenoids are still costly to include in competitive print devices. Third, single motor/electromagnetic clutch or solenoid systems do not permit operation of the cam mechanisms simultaneously. Simultaneous or concurrent operation allows the drum maintenance system to be moved toward the engaged position at the same time that the transfix roller is moved from the loaded position to the unloaded position. Such simultaneous operation increases the speed and efficiency of the print device. Thus, there is a need to provide a single motor system in a print device that will independently operate a transfix roller and a drum maintenance system via a pair of cam mechanisms. Such a system should permit concurrent operation of the transfix roller and the drum maintenance system while reducing reliability issues and cost implications.

The present invention provides a new and improved gear clutch assembly and method for operating a transfix roller and a drum maintenance system within a print device for overcoming the above-referenced drawbacks and others.

BRIEF SUMMARY OF THE INVENTION

In accordance with the present invention, a gear assembly for a print device is provided. More particularly, in accordance with this aspect of the invention, the gear assembly includes an input gear connected to a drive shaft of a motor. The gear assembly further includes a first output gear and a second output gear. The first output gear operates a transfix roller in the print device and is spaced relative to the input gear to allow teeth of the input gear to mesh with teeth of the first output gear. The first output gear includes a first toothless portion that does not mesh with teeth of the input gear when the input gear is adjacent the first toothless portion. The second output gear operates a drum maintenance system in the print device and is spaced relative to the input gear to allow teeth of the input gear to mesh with teeth of the second output gear. The second output gear includes a second toothless portion that does not mesh with teeth of the input gear when the input gear is adjacent the second toothless portion.

The gear assembly further includes a swing arm for rotating the first output gear when the input gear is adjacent the first toothless portion and the second output gear when the input gear is adjacent the second toothless portion. Said rotation of the first output gear moving the first toothless portion away from the input gear and allowing teeth of the input gear to engage teeth of the first output gear. Said rotation of the second output gear moving the second toothless portion away from the input gear and allowing teeth of the input gear to mesh with teeth of the second output gear.

According to another aspect of the present invention, a new and improved print device is provided. More particularly, in accordance with this aspect of the invention, the print device includes a transfer drum for transferring an image to a print medium and a transfix roller for applying a pressure on the print medium against the transfer drum. The print device further includes a drum maintenance system for preparing the transfer drum for subsequent image transfers to the print medium. A first cam assembly is provided for moving the transfix roller between a loaded position where pressure is applied to the print medium against the drum and an unloaded position. A second cam assembly is provided for moving the drum maintenance system between and engaged position wherein the drum maintenance system is capable of preparing the transfer drum for a subsequent image transfer and an idle position.

The print device further includes a single-motor and gear arrangement for selectively moving the first and second cams to control the transfix roller and the drum maintenance system. The arrangement includes a motor having a drive shaft and an input gear connected to the drive shaft.

The arrangement further includes a first output and a second output gear. The first output gear is rotatable between a first output gear engaged position and a first output gear home position. Teeth of the input gear mesh with teeth of the first output gear in the first output gear engaged position and rotation of the input gear will rotate the first output gear. A toothless section of the first output gear is aligned with the input gear in the first output gear home position wherein rotation of the input gear will not rotate the first output gear. The second output gear is rotatable between a second output gear engaged position and a second output gear home position. Teeth of the input gear mesh with teeth of the second output gear in the second output gear engaged position and rotation of the input gear will rotate the second output gear. A toothless section of the second output gear is aligned with the input gear in the second output gear home position wherein rotation of the input gear will not rotate the second output gear.

The arrangement further includes a swing arm connected to the drive shaft that is movable between a swing arm first engaged position and a swing arm second engaged position. In the swing arm first engaged position, the swing arm is capable of moving the first output gear from the first output gear home position to the first output gear engaged position. In the second swing arm engaged position, the swing arm is capable of moving the second output gear from the second output gear home position to the second output gear engaged position. The first output gear is adapted to move the first cam assembly upon rotation of the first output gear thereby moving the transfix roller between the loaded and unloaded positions. The second output gear is adapted to move the second cam assembly upon rotation of the second output gear thereby moving the drum maintenance system between an engaged position and an idle position.

According to still another aspect of the invention, a method of controlling a transfix roller and a drum maintenance system using a single motor and gear arrangement is provided. More particularly in accordance with this aspect of the invention, the method includes the step of rotating an input gear in a first direction to move a swing arm into engagement with a first output gear and rotate the first output gear away from a first output gear home position. A transfix roller is in an unloaded position when the first output gear is in the first output gear home position. The input gear is continued to be driven in the first direction to rotate the first output gear when the first output gear is away from the first output gear home position. Rotation of the first output gear to a predetermined position causes a transfix roller to move toward a loaded position.

The input gear is rotated in a second direction to move the swing arm into engagement with a second output gear and rotate the second output gear away from a second output gear home position. A drum maintenance system is in an idle position when the second output gear is in the second output gear home position. The input gear is continued to be driven in the second direction to rotate the second output gear when the second output gear is away from the second output gear home position. Rotation of the second output gear to a predetermined position causes a drum maintenance system to move toward an engaged position.

According to another aspect of the invention, a gear clutch assembly for operating a transfix roller and a drum maintenance system in a print device is provided. More particularly, in accordance with this aspect of the invention, the gear clutch assembly includes an input gear adapted to be driven by a motor and a means for moving an associated transfix roller into engagement with an associated transfer drum when the input gear is rotated in a first direction. The gear clutch assembly further includes a means for disengaging the associated transfix roller from the associated transfer roller while concurrently moving an associated drum maintenance system into engagement with the associated transfer drum when the input gear is driven in a second direction. The gear clutch assembly further includes a means for disengaging the associated drum maintenance system from the associated transfer drum when the input gear is rotated in the first direction.

According to still another aspect of the invention, an electrographic machine is provided. More particularly, in accordance with this aspect of the invention, the electrophotographic machine includes a transfer drum for temporarily receiving an ink image thereon and transferring the ink image to a print medium. A transfix roller assembly having a transfix roller for pressing a print medium against the transfer drum and a drum maintenance system assembly for conditioning the transfer drum are also included. The electrophotographic machine further includes a gear clutch assembly having a drive gear driven by a motor. A first output gear is connected to the transfix roller assembly and adapted to move the transfix roller upon rotation of the drive gear. A second output gear is connected to the drum maintenance system assembly and is adapted to move the drum maintenance system upon rotation of the drive gear. The drive gear is normally disengaged from the first and second output gears. The gear clutch assembly includes a swing arm that upon movement in a first direction causes the drive gear to engage the first output gear and upon movement in a second direction causes the drive gear to engage the second output gear. Rotation of the drive gear in a first direction moves the swing arm in the first direction and rotation of the drive gear in a second direction moves the swing arm in the second direction.

A primary advantage of the present invention is the provision of a gear clutch assembly and method for operating a transfix roller and a drum maintenance system in a print device that uses a single motor and does not require electromagnetic solenoids or clutches.

A further advantage of the present invention is the provision of an assembly for operating a transfix roller and drum maintenance system that is more reliable and less costly than other operating alternatives.

A further advantage of the present invention is the provision of a gear clutch assembly that allows either or both the transfix roller and the drum maintenance system to be selectively, independently driven.

A still further advantage of the present invention is the provision of a gear clutch assembly that allows simultaneous or concurrent driving of the transfix roller and the drum maintenance system.

Further advantages and benefits of the present invention will become apparent to those of ordinary skill in the art upon reading and understanding the following detailed description of the preferred embodiment.

BRIEF DESCRIPTION OF THE DRAWINGS

The invention may take physical form in certain parts and arrangement of parts, a preferred embodiment of which will be described in detail in this specification and illustrated in the accompanying drawings which form a part hereof and wherein.

DETAILED DESCRIPTION OF THE INVENTION

Figure 1:
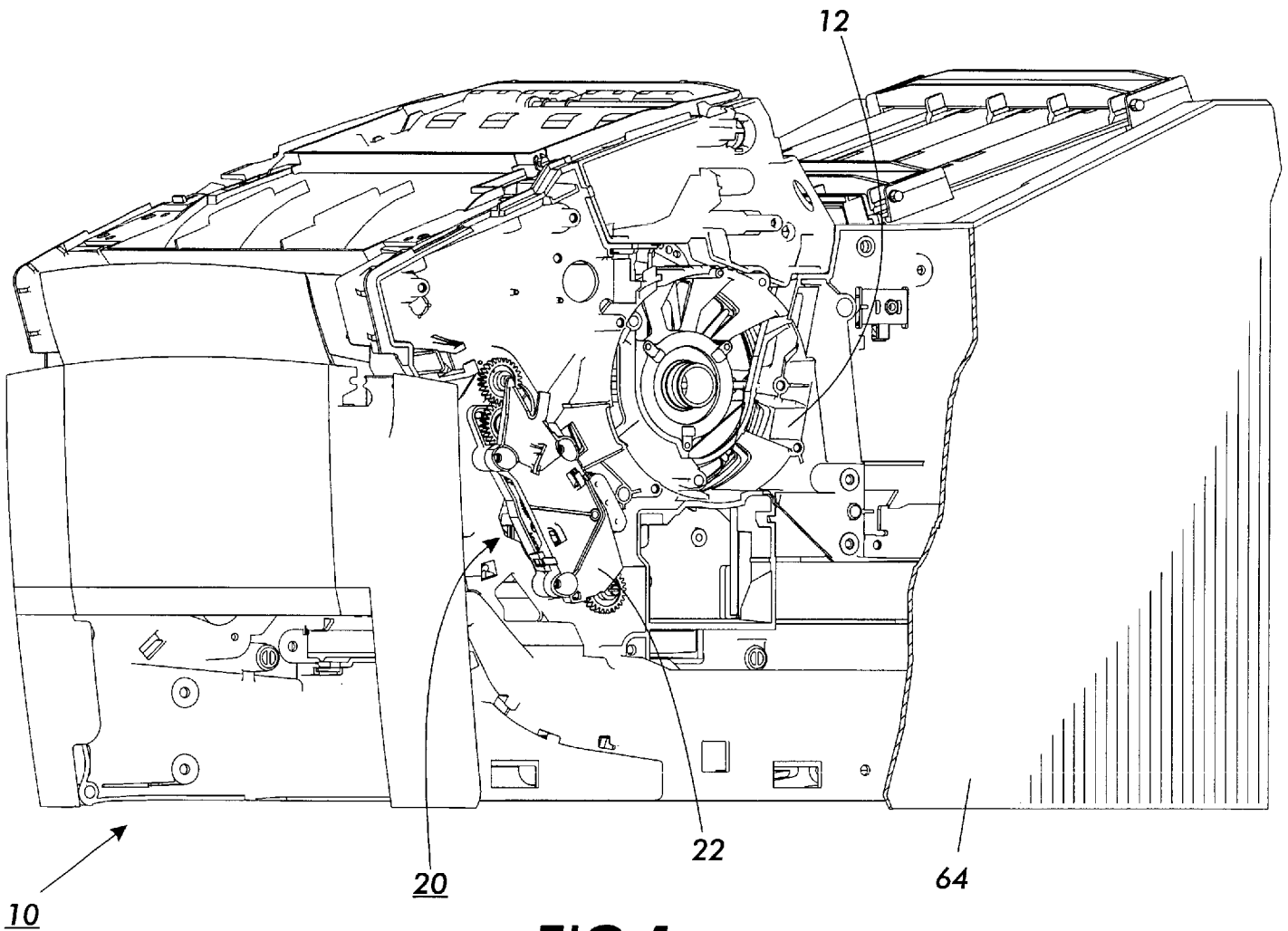
FIG. 1 is a perspective view of a print device shown with a side cover of the print device removed to reveal a transfer drum and a gear clutch assembly operatively received within the print device.

Referring now to the drawings wherein the showings are for purposes of illustrating the preferred embodiment of the invention only and not for purposes of limiting the same, FIG. 1 shows a print device having a transfer drum 12 rotatably mounted therein. The print device 10 further includes a print head (not shown) for spraying ink onto the transfer drum 12, a preheater (not shown) for heating a print or receiving medium, such as a sheet of paper, prior to said receiving medium engaging the transfer drum 12, a transfix roller 14 (FIG. 4) for applying pressure to the receiving medium against the transfer drum 12 as the receiving medium passes the transfer drum 12 and a drum maintenance system 16 (FIG. 5). The drum maintenance system 16 includes a roller for applying an oil or like substance to the transfer drum 12 to prevent ink from sticking thereto and a rubber blade for metering the oil applied to the transfer drum 12. As will be discussed in more detail below, a motor driven gear clutch assembly 20 operates or controls the engagement and disengagement of the transfix roller 14 and the engagement and disengagement of the drum maintenance system 16.

Figure 2:
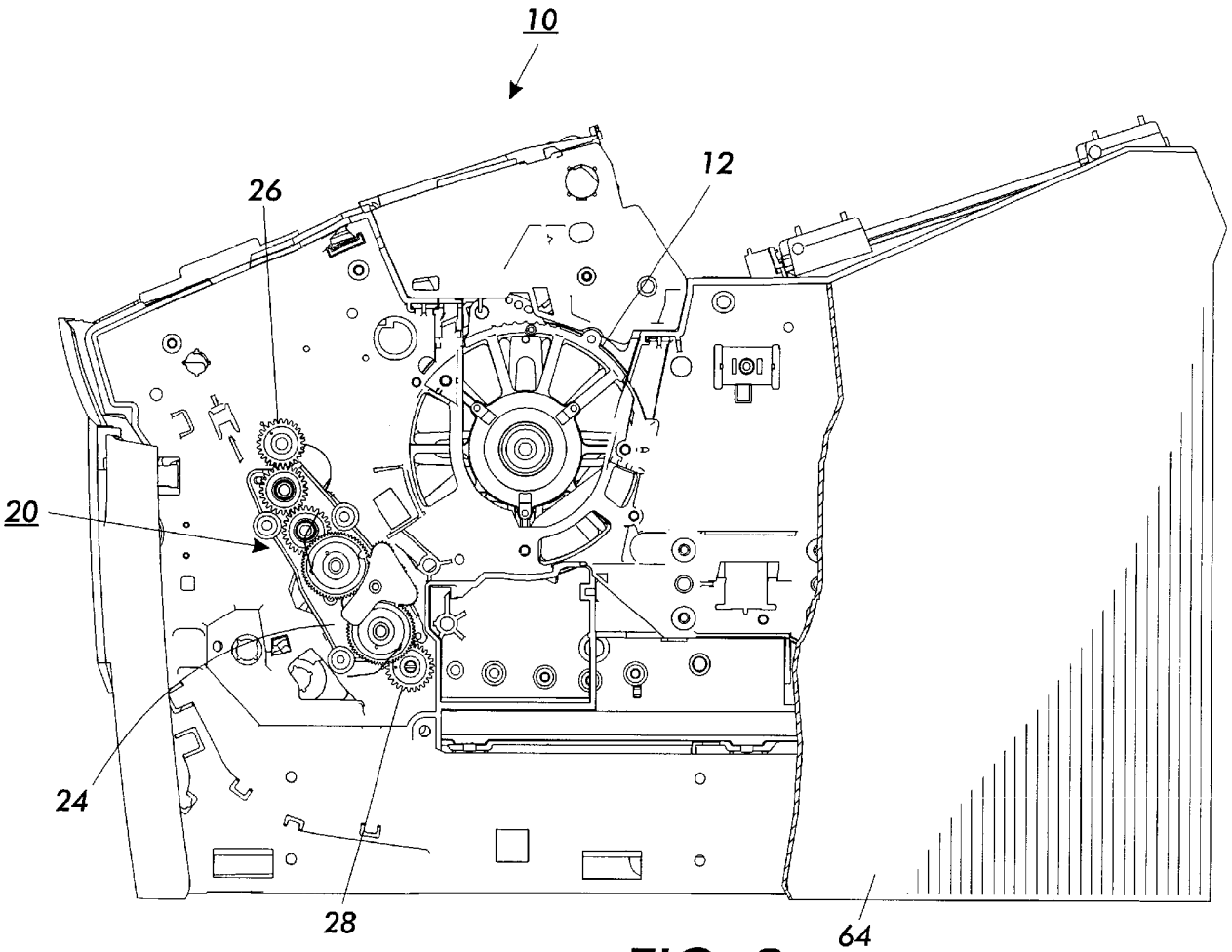
FIG. 2 is a side elevational view of the print device of FIG. 1 wherein the gear clutch assembly is shown with a cover of the gear clutch assembly removed to reveal internal gears and a swing arm.

With reference to FIG. 2, the gear clutch assembly 20 is shown with a first housing piece 22 (FIG. 1) removed from a housing 24 of the gear clutch assembly 20. Gears of the gear clutch assembly 20 are in meshing relation with a transfix driving gear 26 and a drum maintenance driving gear 28. With additional reference to FIG. 3, the transfix driving gear 26 is a component of a transfix cam shaft assembly 30 which includes a transfix cam shaft 32 and first and second cams 34,36. The cams 34,36 are substantially similar in their profiles. Rotation of the transfix driving gear 26 will rotate the cam shaft 32 and the cams 34,36 mounted thereto. The drum maintenance driving gear 28 is a component of a drum maintenance cam shaft assembly 40 which includes a drum maintenance cam shaft 42 and first and second cams 44,46 mounted to the cam shaft 42. The cams 44,46 have profiles that are substantially similar. Rotation of the drum maintenance driving gear 28 will rotate the cam shaft 42 and the cams 44,46. A motor 48 is separately connected to the gear clutch assembly 20 to drive the gears of the gear clutch assembly 20 as will be described in more detail below.

Figure 4:
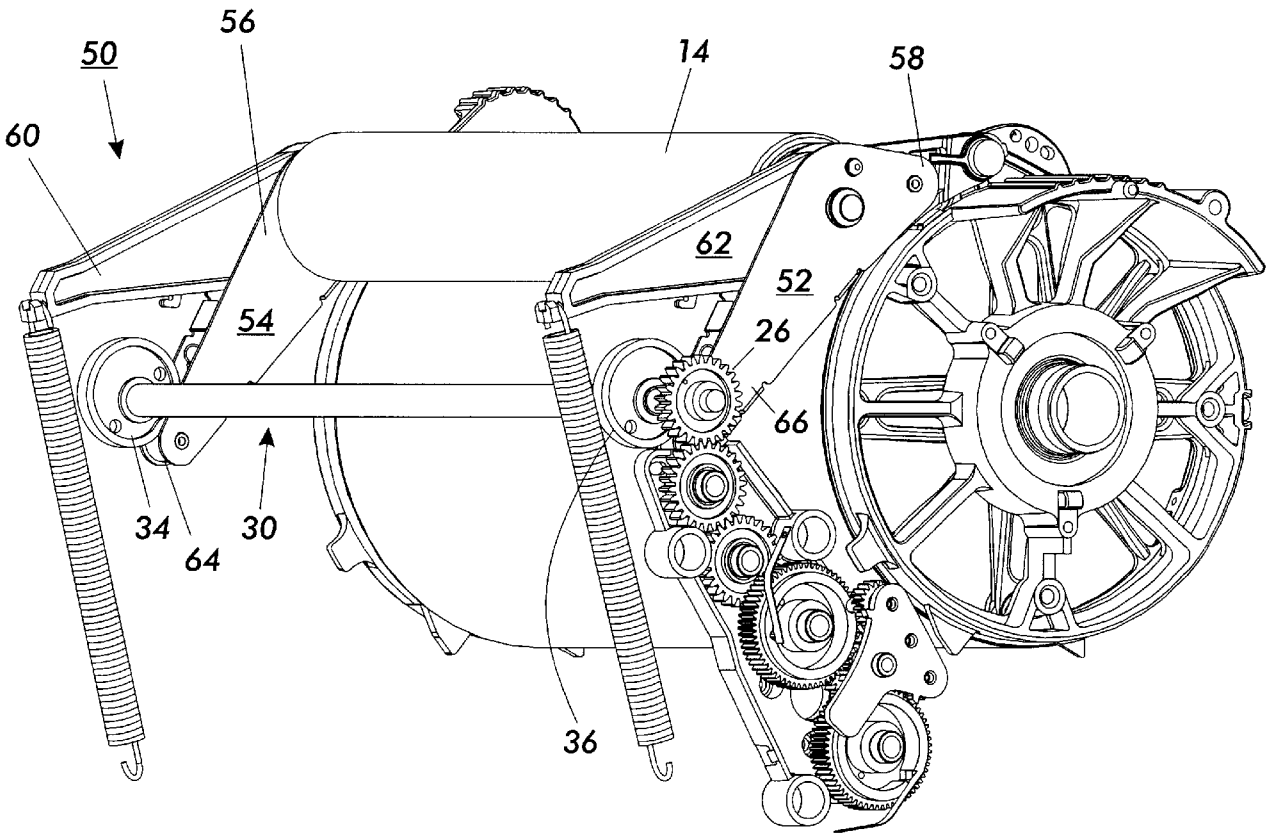
FIG. 4 is a perspective view of select components of the print device of FIG. 2 including the transfer drum, the gear clutch assembly and a transfix roller assembly having a transfix roller.
Figure 5:
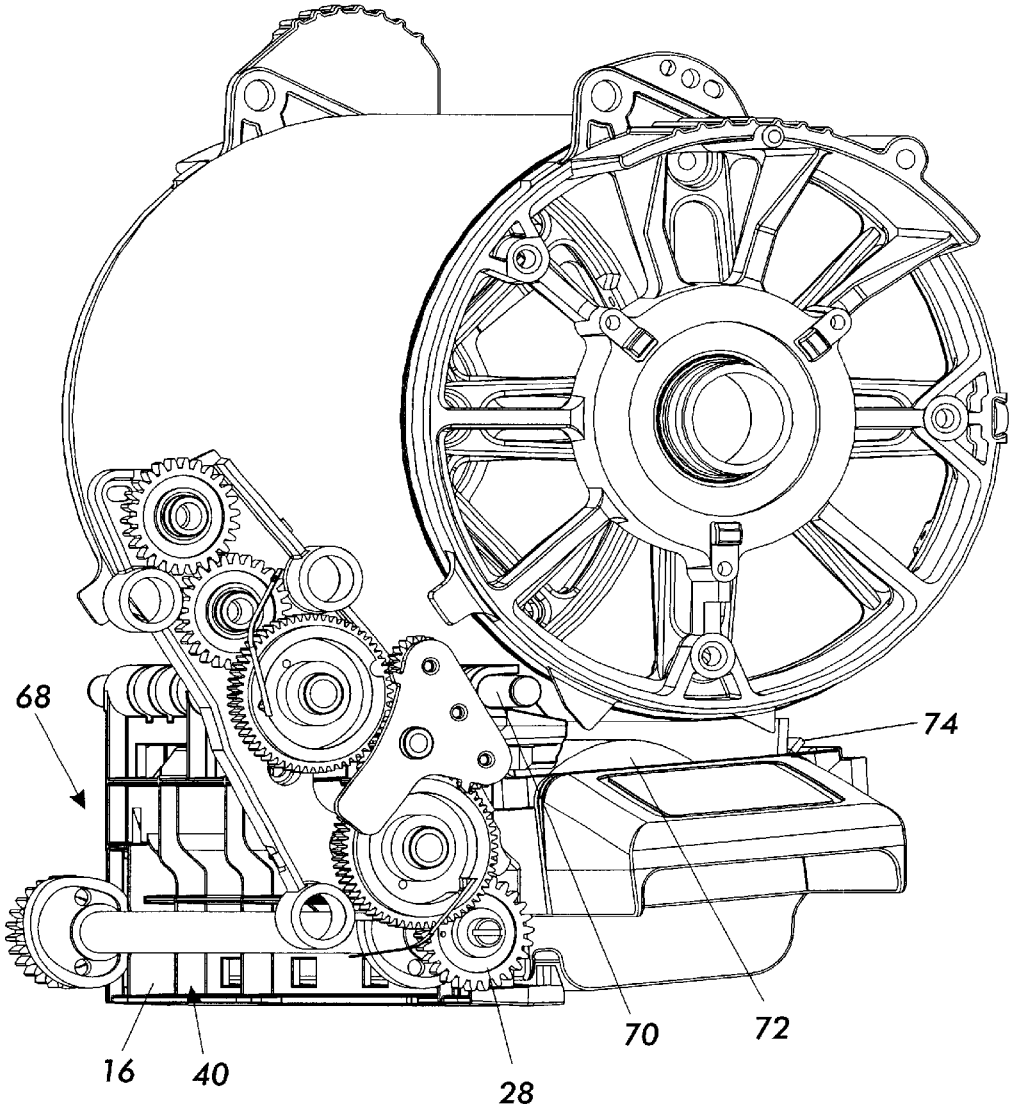
FIG. 5 is a perspective view of select components of the print device of FIG. 2 including the transfer drum, the gear clutch assembly and a drum maintenance system assembly.

With reference to FIG. 4, a transfix roller mechanism or assembly 50 is shown. The transfix roller assembly 50 includes the transfix cam shaft assembly 30 and the transfix roller 14 rotatably mounted to first and second lever arms 52,54 adjacent first ends 56,58 of the lever arms 52,54. The lever arms 52,54 are connected to spring loaded arms 60,62 which are pivotably mounted to a housing 64 (FIG. 1) of the print device 10. The cams 34,36 are in abutting engagement with the lever arms 52,54 adjacent second ends 64,66 of the lever arms 52,54.

With reference to FIG. 5, a drive maintenance system mechanism or assembly 68 is shown. The drum maintenance system assembly 68 includes the drum maintenance cam shaft assembly 40 and the drum maintenance system 16 pivotably mounted to the housing 64 of the print device 10 via a pivot shaft 70. The drum maintenance oil roller 72 and the metering blade 74 are included as part of the drum maintenance system 16 and are adapted to engage the transfer drum 12 when the drum maintenance system 16 is in the engaged position. The cams 44,46 of the drum maintenance cam shaft assembly are in abutting engagement with the drum maintenance system 16.

Figure 6:
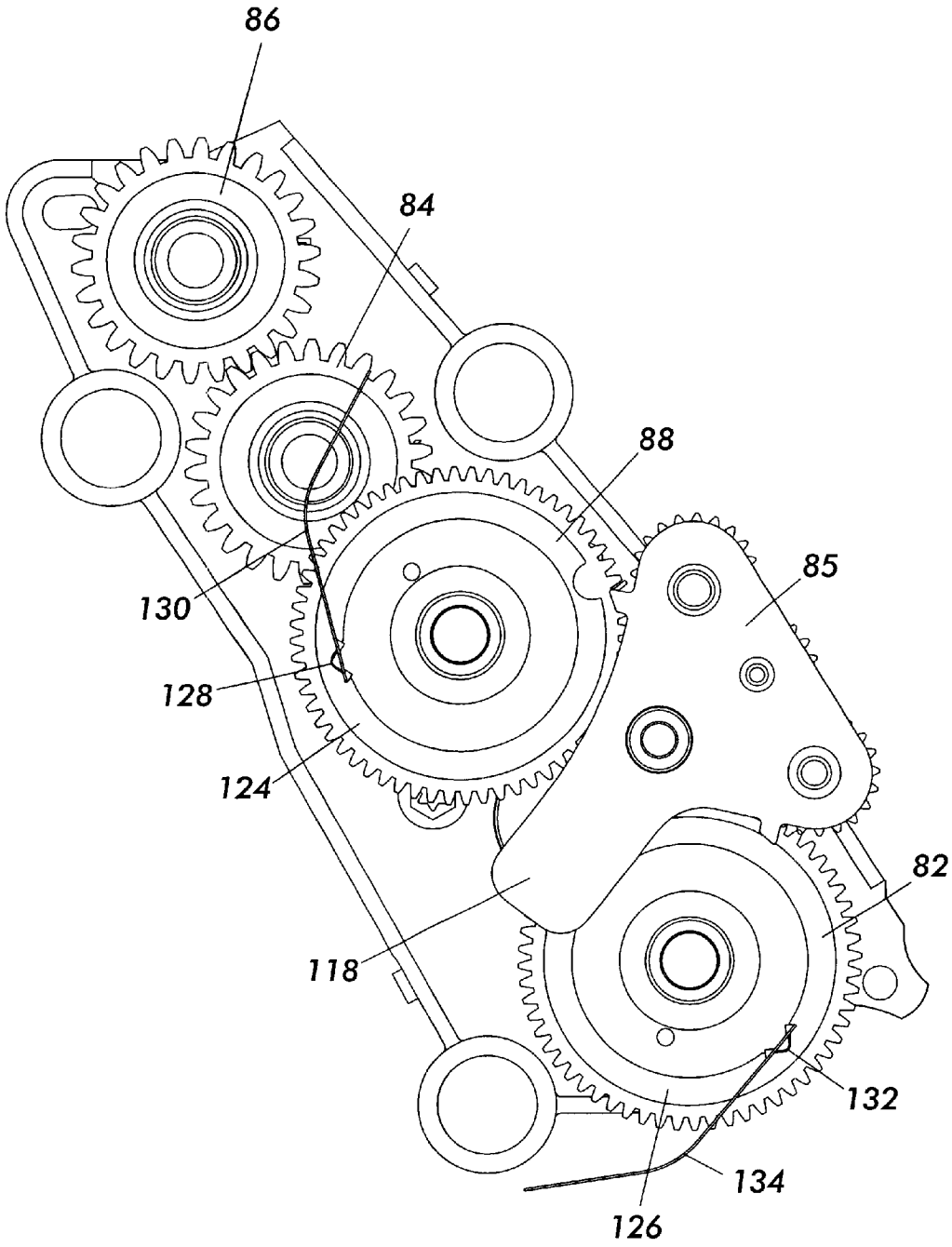
FIG. 6 is a perspective view of the gear clutch assembly of FIG. 2 showing a swing arm and first and second output gears.

With reference to FIG. 6, the clutch assembly 20 includes a first output gear 80, a second output gear 82, a pair of connecting gears 84,86 and a swing arm 88. With additional reference to FIG. 7, the first and second output gears 80,82 are double gears, i.e., each of the output gears 80,82 includes a large gear section concentric with and axially spaced from a small gear section. A small gear section 90 of the first output gear 80 is in meshing relation with the adjacent connecting gear 84. The second connecting gear 86 interconnects the first connecting gear 84 and the transfix driving gear 26 (FIG. 4). Thus, rotation of the first output gear 80 causes rotation of the transfix driving gear 26. A small gear section 92 of the second output gear 82 is in meshing relation with the drum maintenance driving gear 28. Thus, rotation of the second output gear 82 causes rotation of the drum maintenance driving gear 28.

Figure 3:
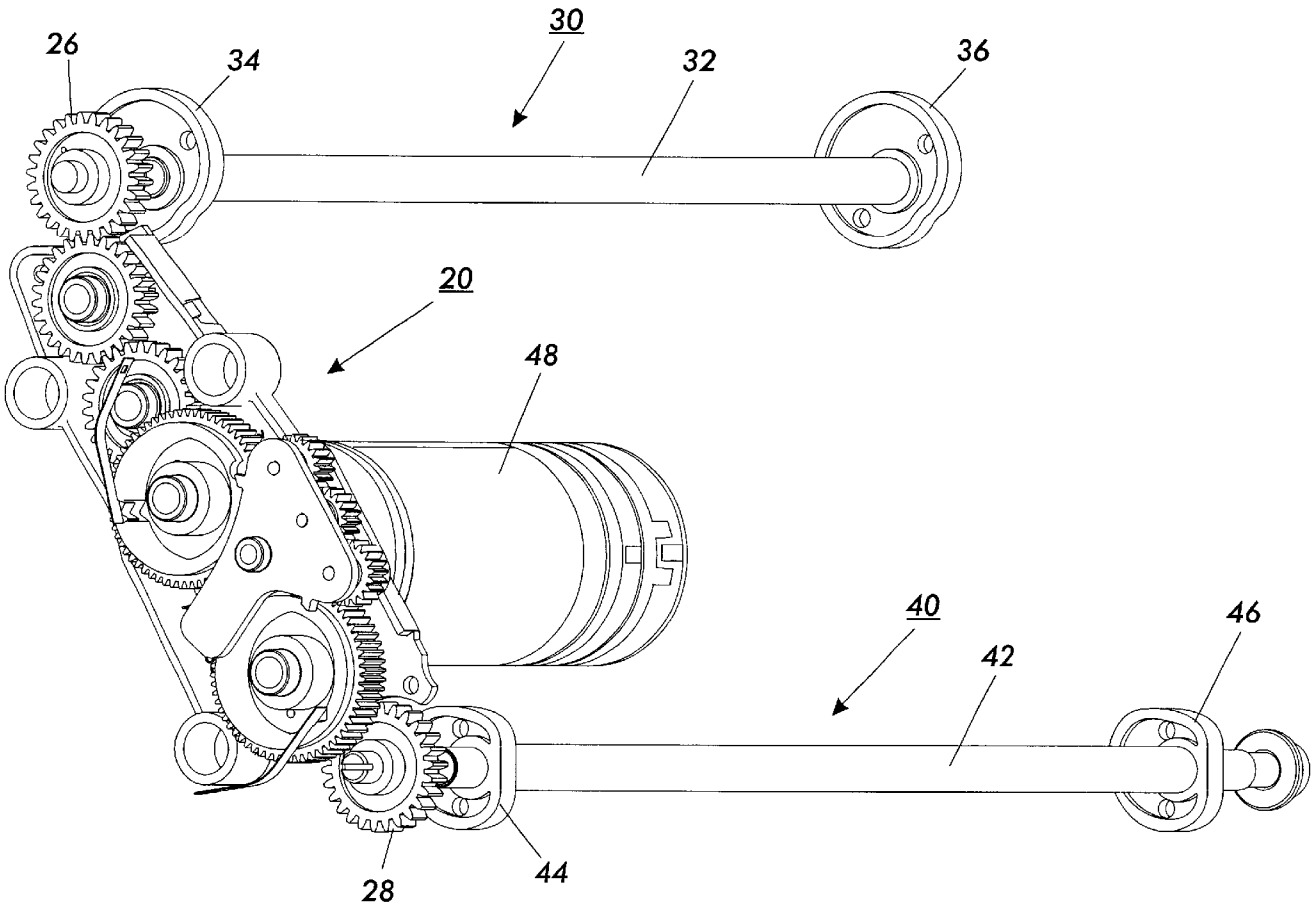
FIG. 3 is perspective view of select components of the print device of FIG. 2 including the gear clutch assembly, a motor, and first and second cam shaft assemblies operatively engaged with the gear clutch assembly.
Figure 7:
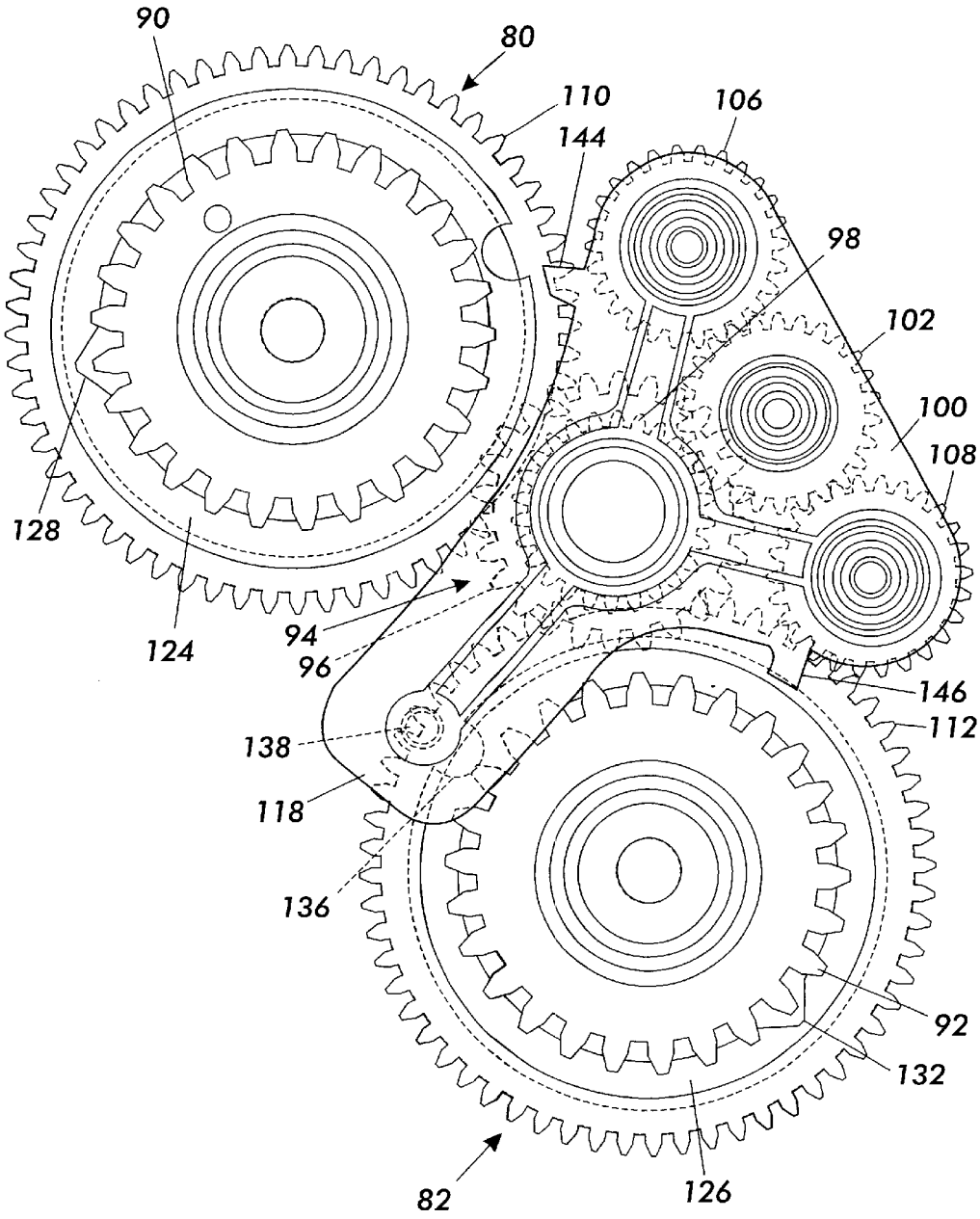
FIG. 7 is a schematic view showing all toothed surfaces of the swing arm and the first and second output gears of FIG. 6 wherein the swing arm is shown including a drive gear and a set of idle gears.

With continued reference to FIG. 7, the swing arm 88 includes a drive or input gear 94 that is a double gear like the first and second output gears 80,82. A large gear section 96 of the input gear 94 is in meshing relation with a gear (not shown) formed on or mounted to a drive shaft of the motor 48 (FIG. 3). A small gear section 98 of the input gear 94 is positioned to be capable of meshing engagement with the first and second output gears 80,82 as will be described in more detail below. The swing arm 88 additionally includes a swing arm body 100 which is pivotable about an axis that is shared with an axis of rotation of the input gear 94. The body 100 includes a middle idle gear 102 positioned in meshing relation with a small gear section 98 of the input gear 94.

The swing arm 88 further includes a first idle gear 106 and a second idle gear 108. The first idle gear 106 is positioned on the swing arm 88 to be in meshing relation with the middle idle gear 102 and is capable of meshing relation with a large gear section 110 of the first output gear 80 when the swing arm 88 is pivoted into the first output gear 80 as will be described below. The second output idle gear 108, similar to the first idle gear 106, is positioned on the swing arm to be in meshing relation with the middle idle gear 102. The second idle gear 108 is also capable of meshing relation with a large gear section 112 of the second output gear 82 when the swing arm 88 is pivoted into the second output gear 82 as will be described below. The swing arm 88 also includes an extension arm 118 extending in the direction of the second output gear 82.

The swing arm 88 includes a friction means (not shown) to resist torsional forces exerted on the idle gears 102,106, 108. The friction means, in a preferred embodiment, is a spring positioned between the body 100 of the swing arm 88 and the middle idle gear 102. The friction means restrains rotation of the middle idle gear 102. Alternatively, the friction means could be a rubber O-ring positioned between the swing arm body 100 and the middle idle gear 102 or the gears could be designed to have sufficient drag such that the swing arm 88 would tend to pivot until the drag forces were overcome. It is to be appreciated that other friction means may be employed by one skilled in the art and all such friction means are to be considered within the scope of the present invention. Thus, the swing arm 88 will tend to pivot about its axis of rotation when rotational forces are applied from the input gear 94 to the middle idle gear 102 unless the forces are sufficient to overcome the torsional resistance, such as when the swing arm 88 is prevented from further pivoting but the drive gear 94 continues to rotate.

Figure 8:
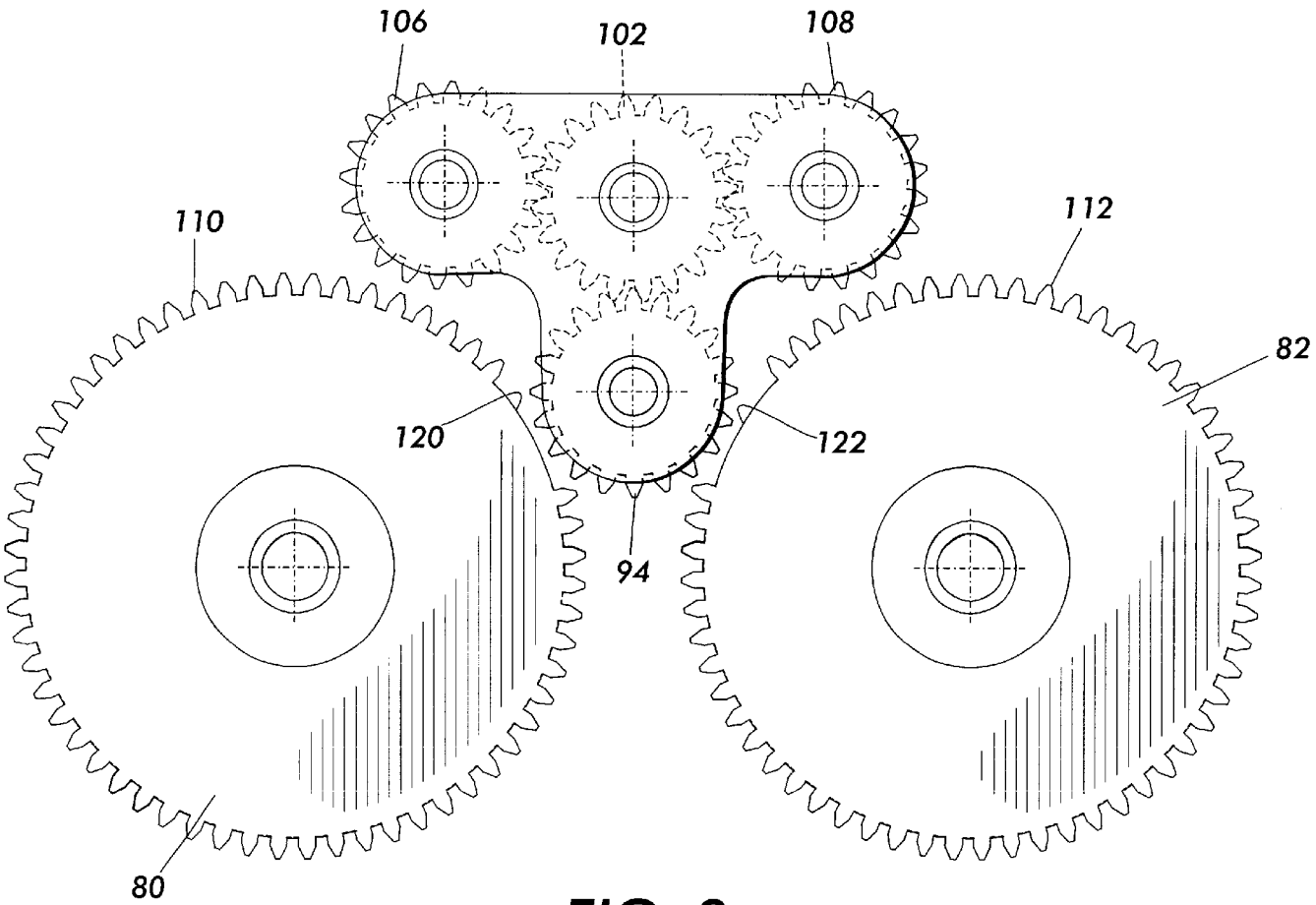
FIG. 8 is a schematic view of the swing arm and the first and second output gears of FIG. 7 wherein the first and second output gears are in respective home positions and the swing arm is in a disengaged position.

With additional references to FIG. 8, the large gear section 110 of the first output gear 80 includes a toothless section or portion 120. Likewise the large gear section 112 of the second output gear 82 includes toothless section or portion 102. As shown in FIG. 8, the first output gear 80 is in a home position when the gap or toothless portion 120 is adjacent the input gear 94. In this home position, the teeth of the large gear section 110 of the first output gear 80 are not in meshing relation with the input gear 94. Also shown in FIG. 8, the second output gear 82 is in a home position when the gap or toothless section 122 is adjacent the input gear 94. When the second output gear 82 is in the home position, the teeth of its large gear section 112 are not in meshing relation with the input gear 94. If the first output gear 80 is rotated and the drive gear 94 is engaged with the large gear section 110 of the first output gear 80, the first output gear 80 is then in an engaged position. Likewise, if the second output gear 82 is rotated and the second output gear 82 is engaged with the drive gear 94, the second output gear 82 is in an engaged position.

With reference to FIGS. 6 and 7, the first and second output gears 80,82 each include raised annular sections 124,126. On an internal diameter of the raised annular section 124, the first output gear includes notch 128 for receiving a first positioning means 130. More specifically, the first positioning means 130 is a leaf spring member connected to a body of the gear clutch assembly 20 and is used to urge the first output gear 80 into its home position when the first output gear 80 is at or near its home position. Likewise, on an internal diameter of the raised annular section 126, the second output gear 82 includes a notch 132 for receiving a second positioning means 134. More specifically, the second positioning means 134 is a leaf spring member connected to a body of the gear clutch assembly 20 and is used to urge the second output gear 82 into its home position when the second output gear 82 is at or near its home position.

With reference to FIG. 7, the raised annular section 126 of the second output gear 82 includes a second outer notch 136 located on an outside diameter of the raised annular section 126. The notch 36 receives a protruding pin 138 of the extension arm 118. When the pin 138 is received by the notch 136, the swing arm 88 is permitted to pivot toward the first output gear 80.

The swing arm 88 includes first and second stops 144,146 that engage corresponding stops (not shown) on the body of the gear clutch assembly 20. The stops 144,146 are used to limit pivotable movement of the swing arm 88 into either the first output gear 80 or the second output gear 82. More specifically, the stops 144,146 operatively position the swing arm 88 in a preferred position for meshing engagement with the first or second output gears 80,82 when the swing arm 88 is pivoted.

In operation of the print device 10, the print device 10 receives imaging data from a data source. A print driver within the print device 10 processes the imaging data and controls operation of a print engine. The print driver feeds formatted imaging data to the print head and controls the movement of the print head by sending control data to a motor controller that activates a drive mechanism. The print driver also controls the rotation of the transfer drum 12 by providing control data to a motor controller that activates a drum motor. The print head then temporarily creates a printed image on the transfer drum 12. The transfer drum 12 continues to rotate. Meanwhile, a print medium is delivered through the print device 10, through a preheater, into a position between the transfix roller 14 and the transfer drum 12. The transfix roller 14 is moved from an unloaded to a loaded position whereby it applies a pressure to the print medium against the transfer drum 12. At this point, the printed image is transferred from the transfer drum 12 to the print medium. Next, the transfix roller 14 is moved to its unloaded position permitting the print medium to continue on its path to a delivery bin. After the print medium passes the transfix roller 14, the transfer drum 12 has to be conditioned for the next image to be printed thereon. The drum maintenance system 16 performs the conditioning by applying an oil to the transfer drum 14 and using a plastic or rubber blade to meter the oil applied thereto.

The movement of the transfix roller 14 between its loaded and unloaded positions will now be described in more detail. With reference to FIG. 4, rotation of the transfix cam shaft assembly 30 will cause the transfix roller 14 to toggle between its loaded and unloaded positions. More specifically, the cams 34,36 of the transfix cam shaft assembly 30 rest against the lever arms 52,54. When the cams 34,36 are rotated, they move the transfix roller 14 between its loaded position and unloaded position. More generally, rotation of the transfix drive gear 26 will rotate the cam shaft 32 and cams 34,36 assembly thereby moving the transfix roller 14 between its loaded and unloaded positions. As can be seen in FIG. 4, the transfix drive gear 26 is in meshing relation with the intermediate gears 84,86 and the first intermediate gear 84 is in meshing relation with the first output gear 80. Specifically, the first intermediate gear 84 is in meshing relation with the smaller gear section 90 of the first output gear 80. Thus, when the first output gear 80 is rotated, the intermediate gears 84,86 rotate the transfix drive gear 26 which rotates the transfix cam shaft assembly 30 thereby moving the transfix roller 14 between its loaded and unloaded positions.

When the first output gear 80 is in its home position, the cams 34,36 of the transfix assembly 30 are oriented such that the transfix roller 14 is in its unloaded position. When the first output gear 80 is rotated away from its home position, i.e., into the first output gear engaged position, approximately 165 degrees away from its home position, the transfix cams 34,36 are rotated thereby moving the transfix roller 14 from its unloaded position to its loaded position. In the loaded position, the transfix roller 14 provides a pressure against a print medium sandwiched between the transfix roller 14 and the transfer drum 12.

With reference to FIG. 5, the drum maintenance system 16 works similar to the transfix roller assembly 50. More specifically, the drum maintenance drive gear 28 is in meshing relation with the small gear section 92 of the second output gear 82. The cams 44,46 of the drum maintenance cam shaft assembly 40 are shaped such that rotation thereof will move the drum maintenance system 16 from its disengaged position to its engaged position. Thus, rotation of the second output gear 82 will toggle the drum maintenance system 16 between its disengaged and engaged positions.

When the second output gear 82 is in its home position, the drum maintenance cams 44,46 of the drum maintenance system 16 are oriented such that the drum maintenance system 16 is in its disengaged position. When the second output gear 82 is rotated away from its home position, i.e., into the second output gears engaged position approximately 160 degrees away from its home position, the drive maintenance cams 44,46 are rotated thereby moving the drum maintenance system 16 from its disengaged position to its engaged position. In the engaged position, the drum maintenance system 16 is capable of performing its conditioning function to the transfer drum 12.

Figure 9:
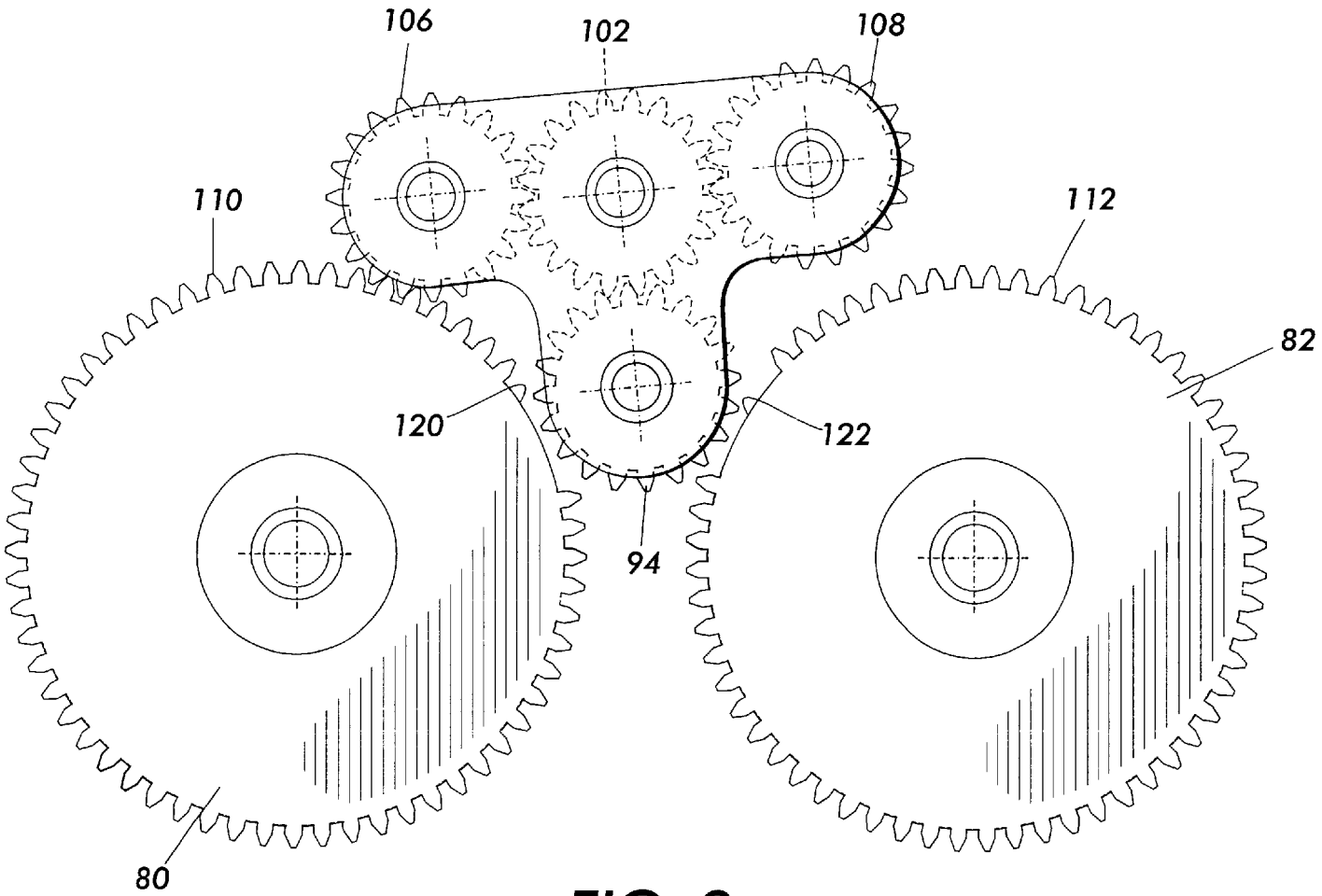
FIG. 9 is a schematic view of the swing arm and the first and second output gears of FIG. 7 wherein the first and second output gears are in respective home positions and the swing arm is engaged to the first output gear.
Figure 10:
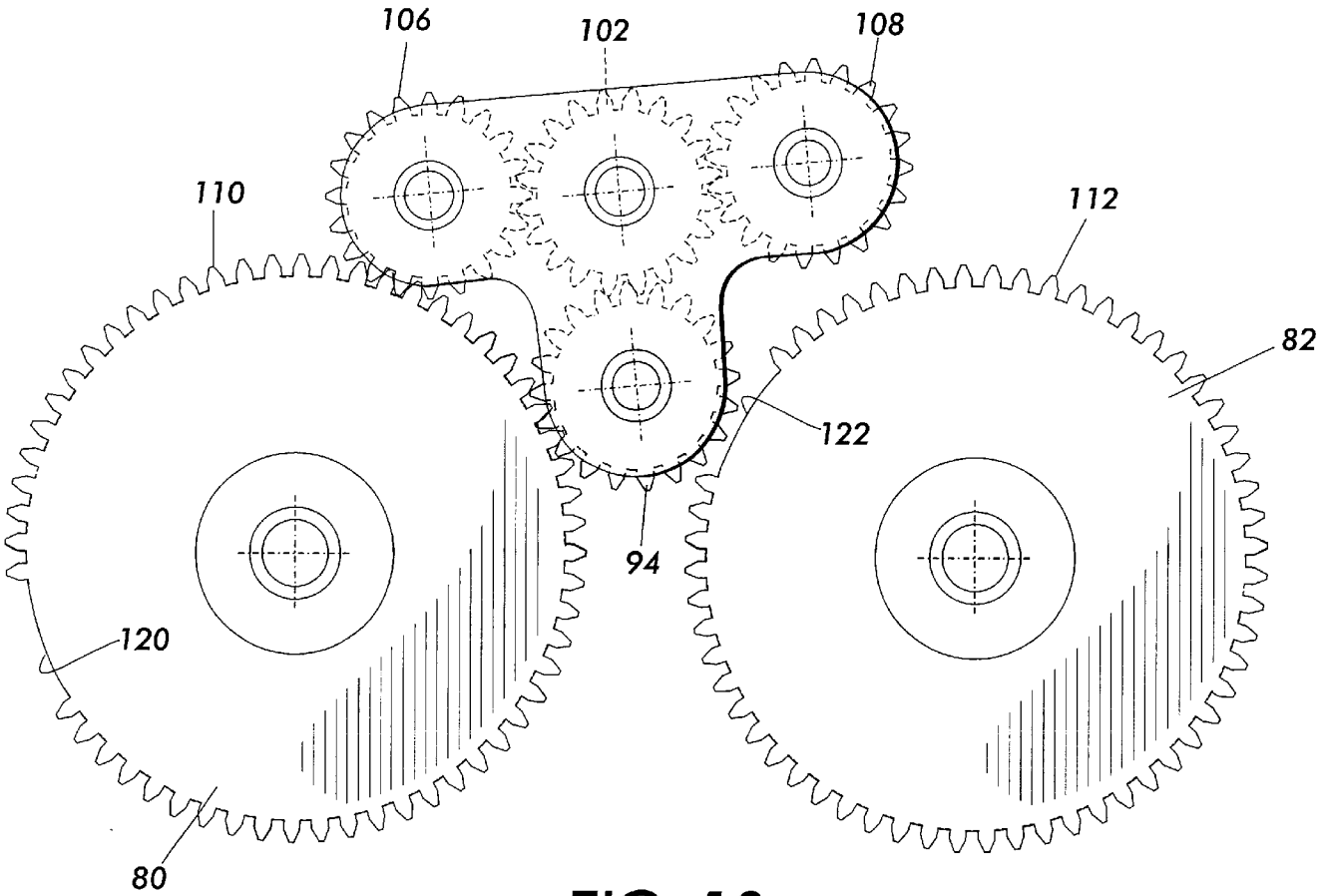
FIG. 10 is a schematic view of the swing arm and the first and second output gears of FIG. 7 wherein the drive gear is engaged with the first output gear and the second output gear is in a home position.

With reference to FIG. 8, the function and operation of the gear clutch assembly 20 will be described in more detail. In FIG. 8, the first and second output gears 80,82 are both shown in their home positions. That is, the toothless sections 120,122 of the first and second output gears 80,82 are adjacent the drive gear 94. As discussed above, when the first and second output gears 80,82 are in their home positions, the transfix roller 14 is in its unloaded position and the drum maintenance system 16 is in its disengaged position. When the print device 10 calls for the transfix roller 14 to move to its loaded position, the drive gear 94 is turned in a direction whereby teeth of the input gear 94 adjacent the middle idle gear 102 move toward the first output gear (counterclockwise in FIG. 8). The friction means resisting torsional forces on the middle idle gear 102 causes the middle idle gear 102 not to rotate upon initial rotation of the drive gear 94. Instead, rotation of the drive gear 94 causes the entire swing arm 88 to pivot about its rotational axis which is also the rotational axis of the drive gear 94. Thus, when the drive gear 94 is initially rotated in this direction and the first output gear 80 is in its home position, the swing arm 88 pivots in the direction of the first output gear 80. The pivoting motion of the swing arm 88 is halted when the stop 144 of the swing arm 88 engages a corresponding stop on the body of the gear clutch assembly 20. At this stopped position, with reference to FIG. 9, the first idle gear 106 is in meshing relation with the first output gear 80. Continued rotation of the drive gear 94, when the first idle gear 106 is in meshing relation with the first output gear 80, overcomes the resistance forces of the friction means and causes the gears 102,106,108 of the swing arm 88 to rotate with the drive gear 94. Thus, the continued rotation of the drive gear 94 now causes the first output gear 80 to rotate in a direction whereby the toothless section 120 moves away from the input gear 94 and the first idle gear 106 (clockwise in FIG. 8). Continued rotation of the input gear 94 will continue to rotate the first output gear 80. However, with reference to FIG. 10, after initial rotation of the first output gear 80, the teeth of the first output gear 80 now engage the drive gear 94 directly. Thus, the drive gear 94 becomes the primary gear rotating the first output gear 80. The first output gear 80 may be rotated to a position approximately 165 degrees from its home position. This movement causes the transfix roller 14 to move from its unloaded position to its loaded position as a result of the cam shaft assembly 30.

Once the printed image transfers from the transfer drum 12 to the print medium, the transfix roller 14 needs to be unloaded from the transfer drum 12. To accomplish this, the direction of the motor 48, and thereby the input gear 94 is reversed. Because the input gear 94 is still engaged with the first output gear 80, the first output gear 80 now starts rotating in a reverse direction back toward its home position (counterclockwise in FIG. 8). Additionally, the frictional means of the middle idle gear 102 of the swing arm 88 again resists torsional forces caused by the rotation of the drive gear 94 in this new, reverse direction. The resistance causes the swing arm 88 to pivot in the direction of the second output gear 82 and away from the first output gear 80. Similar to pivoting motion into the first output gear 80, the swing arm 88 pivots until the stop 146 of the swing arm 88 engages a corresponding stop on the body of the gear clutch assembly 20. When the swing arm 88 stop 146 and the gear clutch assembly stop are in contact with one another, the second idle gear 108 is positioned in meshing relation with the second output gear 82. Further rotation of the input gear 94 now causes the second idle gear 108 to rotate the second output gear 82. Continued rotation of the input gear 94 rotates the second output gear 82 away from its home position (counterclockwise in FIG. 10). Continued rotation of the second output gear 82 causes the drive gear 94 to directly engage the teeth of the second output gear 82. The drive gear 94 then becomes the primary gear rotating the second output gear 82.

Figure 11:
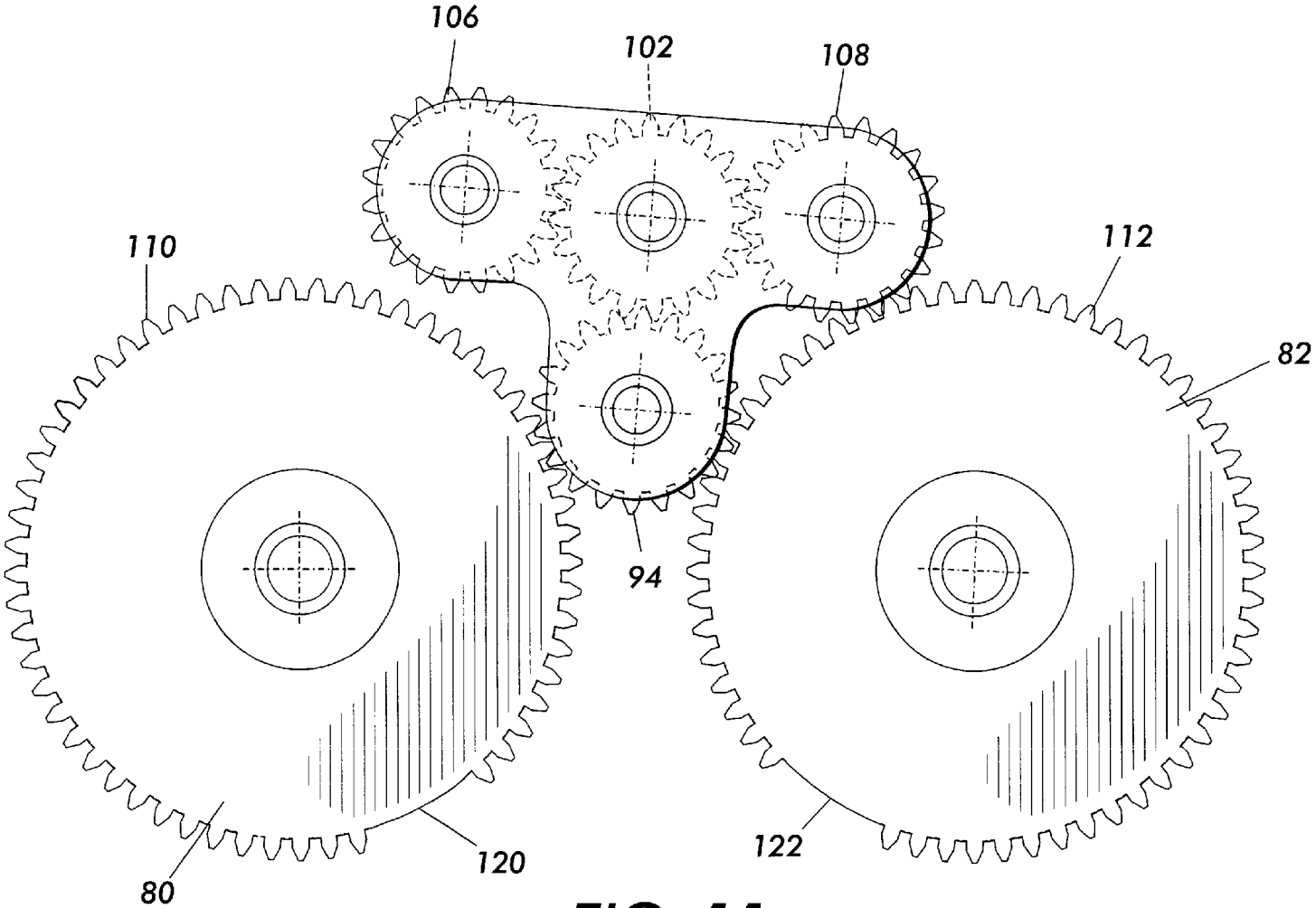
FIG. 11 is a schematic view of the swing arm and the first and second output gears of FIG. 7 wherein the swing arm is engaged with the second output gear and the drive gear is engaged with the first and second output gears.
Figure 12:
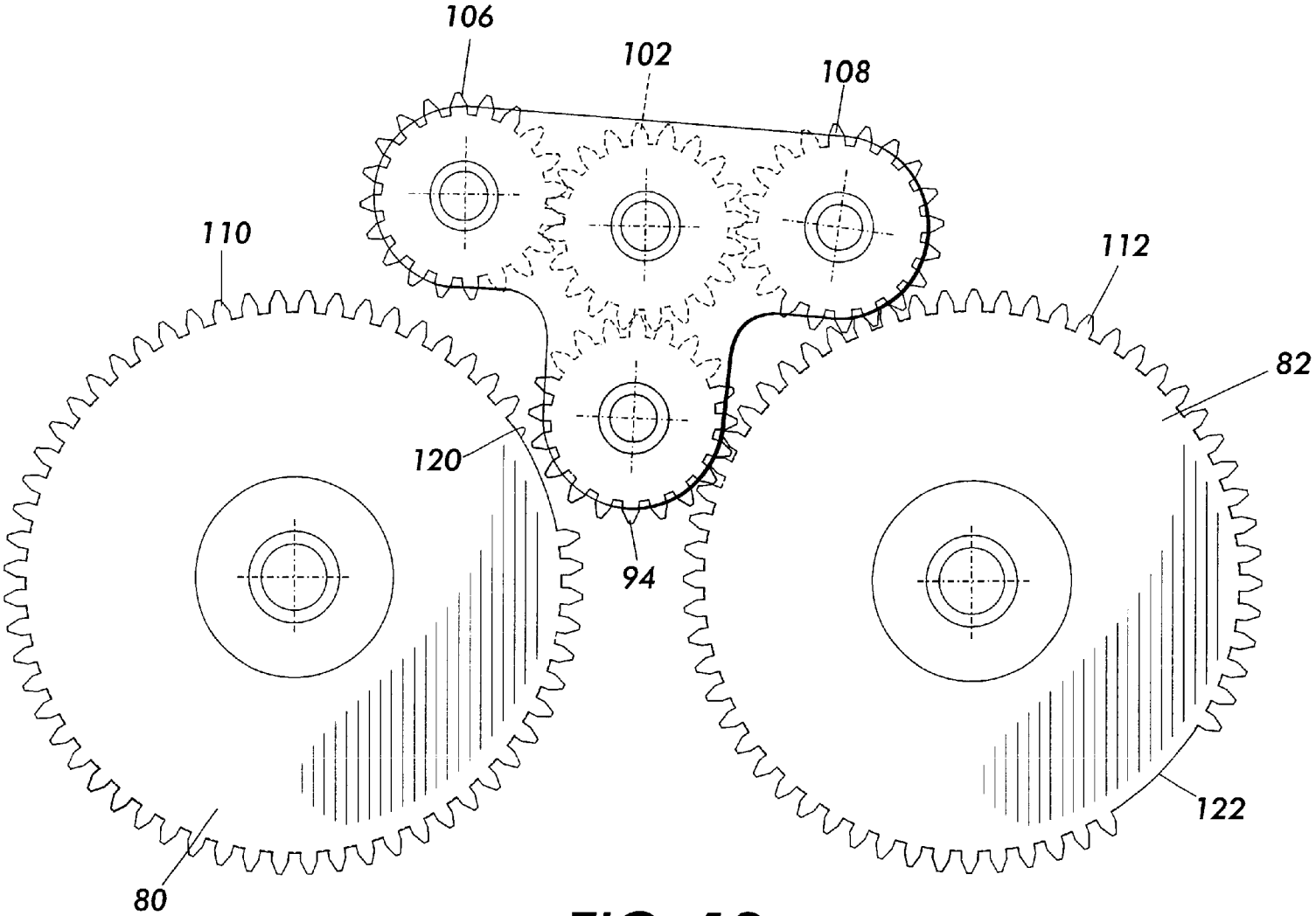
FIG. 12 is a schematic view of the swing arm and the first and second output gears of FIG. 7 wherein the drive engaged with the second output gear and the first output gear in the first output gear is in a home position.

With reference to FIG. 11, continued rotation of the input gear 94 continues to cause the first output gear 80 to move toward its home position and causes the second output gear 82 to move away from its home position. Through the cam shaft assemblies 32,40, the transfix roller 14 is moved from its loaded position to its unloaded position and, simultaneously, drum maintenance system 16 is moved from its unengaged position toward its engaged position. With reference to FIG. 12, this rotation eventually causes the first output gear 80 to return to its home position which thereby means the transfix roller 14 is now in its unloaded position at the same time the second output gear 82 moves to a position approximately 160 degrees away from its home position. At this position, the drum maintenance system 16 is fully engaged with the transfer drum 12.

Upon completion of the drum maintenance function 16, the second output gear 82 needs to return to its home position. Reversing rotation of the input gear 94 will cause an urging force on the swing arm 88 in the direction of the first output gear 80. However, the swing extension arm 118 and the engagement between the protrusion pin 138 and the annular raised section 126 (FIG. 7) on the second output gear 82 prevents the swing arm 88 from fully pivoting in the direction of the first output gear 80. More specifically, when the protrusion pin 138 of the extension arm 118 is not engaged in the notch 136 of the second output gear 82, the swing arm 88 is prevented from pivoting toward the first output gear 80. Thus, rotation of the input gear 94 does not pivot the swing arm 88 toward the first output gear 80 when the second output gear 82 is not in its home position but does continue to rotate the second output gear 82 back toward its home position.

Notably, the first and second output gears 80,82 are not rotated 360 degrees and, likewise, the camshafts 32,42 are not rotated 360 degrees. This prevents the gear phenomenon known as backlash from negatively impacting the printing process. Specifically, backlash causes an undesirable noise during the printing process. Backlash is eliminated by reversing the rotation of the respective first and second output gears 80,82 and not rotating either of the first and second output gears 80,82 beyond approximately 180 degrees.

It is possible, however, to move the transfix roller 14 from its unloaded position to its loaded position and back to its unloaded position without moving the drive maintenance system 16. This would be a desirable action in order to clear a jam from the printer or during a single page print job. In this case, the first output gear 80 is rotated to approximately 160 degrees thereby moving the transfix roller 14 from the unloaded position to the loaded position. In this case, backlash is ignored and upon completion of the transfix from the transfer drum 12 to the print medium, the first output gear 80 is continued to be rotated in its original direction 360 degrees around to the home position.

It may also be desirable to only engage and disengage the drum maintenance system 16. This is accomplished by rotating the drive input gear 94 initially only causing the second output gear 82 to rotate to a position approximately 160 degrees away from the home position whereby the drum maintenance system 16 is fully engaged. In this case, the second output gear 82 can be returned to the home position by either reversing the second output gear's rotation direction or continuing to rotate in the original rotation direction and disregarding any backlash issues. In the preferred embodiment, it is preferable to reverse the direction of the second output gear 82 thereby avoiding the backlash noise issues when returning the second output gear 82 to the home position.

A homing action is also provided with the gear clutch assembly 20 of the present invention whereby both output gears 80,82 are returned to their respective home positions. In this motion, the drive gear 94 is rotated in the direction and amount that would cause the first output gear 80 to rotate 360 degrees if the second output gear 82 was initially in the home position. This motion has the effect of bringing the second output gear 82 back into the home position, regardless of its beginning position. Next, the drive gear 94 is rotated in the direction and amount that will cause the second output gear 82 to rotate 360 degrees. This motion has the effect of beginning the first output gear 82 back into the home position, regardless of its beginning position. This motion has the advantage of being able to return both output gears to their home position regardless of their initial position. For example, when the printer is turned on or off or during a jam or fault condition, it may be necessary to verify that the first and second output gears 80,82 are in fact starting at the home positions. To assure that these gears 80,82 are in the home positions, the homing motion may be completed.

The invention has been described with reference to the preferred embodiment. Obviously, modifications and alterations will occur to others upon reading and understanding the preceding detailed description. It is intended that the invention be construed as including all such modifications and alterations insofar as they are within the scope of the dependent claims or equivalents thereof.

Having thus described the preferred embodiments, the invention is now claimed to be:

1. A gear assembly for a print device comprising:

an input gear connected to a drive shaft of a motor;

a first output gear for operating a transfix roller in the print device spaced relative to the input gear to allow teeth of the input gear to mesh with teeth of the first output gear, the first output gear including a first toothless portion that does not mesh with the teeth of the input gear when the input gear is adjacent the first toothless portion;

a second output gear for operating a drum maintenance system in the print device spaced relative to the input gear to allow teeth of the input gear to mesh with teeth of the second output gear, the second output gear including a second toothless portion that does not mesh with the teeth of the input gear when the input gear is adjacent the second toothless portion; and a swing arm for rotating the first output gear when the input gear is adjacent the first toothless portion and the second output gear when the input gear is adjacent the second toothless portion, said rotation of the first output gear moving the first toothless portion away from the input gear and allowing teeth of the input gear to engage teeth of the first output gear and said rotation of the second output gear moving the second toothless portion away from the input gear and allowing teeth of the input gear to engage teeth of the second output gear.

2. The gear assembly of claim 1 wherein the swing arm is connected to the drive shaft of the motor and selective rotation of the first and second output gears by the swing arm occurs upon actuation of the motor.

3. The gear assembly of claim 2 wherein said actuation of the motor in a first direction causes the swing arm to rotate the first output gear and said actuation of the motor in a second direction causes the swing arm to rotate the second output gear.

4. The gear assembly of claim 1 wherein the swing arm includes:

a body pivotable about an axis of rotation of the input gear;

a middle idle gear rotatably supported by the body and positioned in meshing relation with the input gear;

a first idle gear rotatably supported by the body and positioned in meshing relation with the middle idle gear;

a second idle gear rotatably supported by the body and positioned in meshing relation with the middle idle gear; and a friction element enabling the middle idle gear to resist rotation about its axis of rotation upon rotation of the input gear, said resistance causing the body to pivot in the direction of rotation of the input gear, rotating the input gear in a first direction pivots the body thereby moving the first idle gear into meshing relation with the first output gear and rotating the input gear in a second direction pivots the body thereby moving the second idle gear into meshing relation with the second output gear.

5. The gear assembly of claim 4 wherein further rotation of the input gear in the first direction after the first idle gear is in meshing relation with the first output gear causes the middle idle gear and the first idle gear to rotate thereby rotating the first output gear and further rotation of the input gear in the second direction after the second idle gear is in meshing relation with the second output gear causes the middle idle gear and the second idle gear to rotate thereby rotating the second output gear.

6. The gear assembly of claim 4 wherein the friction element is a spring acting between the body and the middle idle gear to provide torsional resistance to the middle idle gear.

7. The gear assembly of claim 4 wherein the gear assembly further comprises stops to limit the pivoting movement of the body at a precise position in at least one of the first and second pivoting directions.

8. The gear assembly of claim 1 wherein rotation of the input gear immediately rotates the first output gear unless the toothless portion of the first output gear is adjacent the input gear preventing the input gear and the first output gear from having a meshing relation and rotation of the input gear immediately rotates the second output gear unless the toothless portion of the second output gear is adjacent the input gear preventing the input gear and the second output gear from having a meshing relation.

9. The gear assembly of claim 1 further comprising a positioning member for urging at least one of the first and second output gears into a position whereby the toothless portion of said at least one of the first and second output gears is adjacent the input gear.

10. The gear assembly of claim 1 further comprising a swing arm limiter that prevents the swing arm from rotating one of the first and second output gears when the input gear is adjacent the toothless portion of said one of the first and second output gears if the toothless portion of the other one of the first and second output gears is not adjacent the input gear.

11. A print device, comprising:

a transfer drum for transferring an image to a print medium;

a transfix roller for applying a pressure on the print medium against the transfer drum;

a drum maintenance system for preparing the transfer drum for subsequent image transfers to the print medium;

a first cam assembly for moving the transfix roller between a loaded position where pressure is applied to the print medium against the drum and an unloaded position;

a second cam assembly for moving the drum maintenance system between an engaged position wherein the drum maintenance system is capable of preparing the transfer drum for a subsequent image transfer and an idle position; and a single-motor and gear arrangement for selectively moving the first and second cams to control the transfix roller and the drum maintenance system, the arrangement comprising:

a motor having a drive shaft;

an input gear connected to the drive shaft;

a first output gear rotatable between a first output gear engaged position and a first output gear home position, teeth of the input gear mesh with teeth of the first output gear when the first output gear is in the first output gear engaged position and rotation of the input gear will rotate the first output gear, a toothless section of the first output gear is aligned with the input gear in the first output gear home position wherein rotation of the input gear will not rotate the first output gear;

a second output gear rotatable between a second output gear engaged position and a second output gear home position, teeth of the input gear mesh with teeth of the second output gear when the second output gear is in the second output gear engaged position and rotation of the input gear will rotate the second output gear, a toothless section of the second output gear is aligned with the input gear in the home second output gear position wherein rotation of the input gear will not rotate the second output gear;

a swing arm connected to the drive shaft and movable between a swing arm first engaged position and a swing arm second engaged position, in the swing arm first engaged position the swing arm is capable of moving the first output gear from the first output gear home position to the first output gear engaged position, in the swing arm second engaged position the swing arm is capable of moving the second output gear from the second output gear home position to the engaged position;

said first output gear adapted to move the first cam upon rotation of the first output gear thereby moving the transfix roller between the loaded and unloaded positions; and said second output gear adapted to move the second cam upon rotation of the second output gear thereby moving the drum maintenance system between an engaged position and an idle position.

12. The print device of claim 11 wherein the swing arm includes:

a middle idle gear in meshing relation with the input gear;

a first idle gear in meshing relation with the middle idle gear and movable into meshing relation with the first output gear when the swing arm is moved to the swing arm first engaged position;

a second idle gear in meshing relation with the middle idle gear and movable into meshing relation with the second output gear when the swing arm is moved to the swing arm second engaged position.

13. The print device of claim 12 wherein the swing arm further includes:

a friction member for resisting rotation of at least one of the middle idle gear, the first idle gear and the second idle gear upon rotation of the input gear.

14. A method of controlling a transfix roller and a drum maintenance system using a single motor and gear arrangement, the method comprising:

(a) rotating an input gear in a first direction to move a swing arm into engagement with a first output gear and rotate the first output gear away from a first output gear home position, a transfix roller in an unloaded position when the first output gear is in the first output gear home position;

(b) continue driving the input gear in the first direction to rotate the first output gear when the first output gear is away from the first output gear home position, rotation of the first output gear to a predetermined position causing a transfix roller to move toward a loaded position;

(c) rotating the input gear in a second direction to move the swing arm into engagement with a second output gear and rotate the second output gear away from a second output gear home position, a drum maintenance system in an idle position when the second output gear is in the second output gear home position;

(d) continue driving the input gear in the second direction to rotate the second output gear when the second output gear is away from the second output gear home position, rotation of the second output gear to a second output gear predetermined position causing a drum maintenance system to move toward an engaged position.

15. The method of claim 14 wherein the continued driving of the input gear in a second direction of step (d) rotates the first output gear from the first output gear predetermined position to the first output gear home position thereby causing the transfix roller to move toward its unloaded position.

16. The method of claim 15 further including the step of:

rotating the input gear in one of the first and second directions to rotate the second output gear from the second output gear predetermined position to the second output gear home position thereby causing the drum maintenance system to move toward the idle position.

17. The method of claim 16 further including the step of:

only rotating the input gear in the first direction to rotate the second output gear to the second output gear home position to prevent backlash.

18. The method of claim 14 further including the step of:

preventing the swing arm from engaging the first output gear upon rotation of the input gear in the first direction when the second output gear is away from the second output gear home position.

19. The method of claim 14 further including the step of:

urging the first and second output gears to the respective first and second output gear home positions.

20. The method of claim 19 wherein the step (b) further includes:

continuing to rotate the input gear until the transfix gear is in the loaded position.

21. A gear clutch assembly for operating a transfix roller and a drum maintenance system in a print device, the gear clutch assembly comprising:

an input gear adapted to be driven by a motor;

a means for moving an associated transfix roller into engagement with an associated transfer drum when the input gear is rotated in a first direction;

a means for disengaging the associated transfix roller from the associated transfer roller while concurrently moving an associated drum maintenance system into engagement with the associated transfer drum when the input gear is driven in a second direction;

a means for disengaging the associated drum maintenance system from the associated transfer drum when the input gear is rotated in the first direction.

22. The gear clutch assembly of claim 21 wherein the means for disengaging the associated drum maintenance system from the associated transfer drum prevents the associated transfix roller from engagement with the associated transfer drum prior to disengagement of the associated drum maintenance system from the associated transfer drum.

23. An electrophotographic machine, comprising:

a transfer drum for temporarily receiving an ink image thereon and transferring said ink image to a print medium;

a transfix roller assembly having a transfix roller for pressing a print medium against the transfer drum;

a drum maintenance system assembly for conditioning the transfer drum;

a gear clutch assembly having a drive gear driven by a motor, a first output gear connected to the transfix roller assembly and adapted to move the transfix roller upon rotation of the drive gear, and a second output gear connected to the drum maintenance system assembly and adapted to move the drum maintenance system upon rotation of the drive gear, said drive gear normally disengaged from said first and second output gears; and said gear clutch assembly including a swing arm that upon movement in a first direction causes said first drive gear to engage the output gear and upon movement in a second direction causes said drive gear to engage said second output gear, rotation of said drive gear in a first direction moves the swing arm in the first direction and rotation of said drive gear in a second direction moves the swing arm in the second direction.

* * * * *